US009368011B2

(12) United States Patent
Sayegh et al.

(10) Patent No.: US 9,368,011 B2
(45) Date of Patent: Jun. 14, 2016

(54) ELECTRONIC ARTICLE SURVEILLANCE

(71) Applicant: Universal Surveillance Systems, LLC, Rancho Cucamonga, CA (US)

(72) Inventors: Adel O. Sayegh, Rancho Cucamonga, CA (US); Edgardo Redublo, Chino Hills, CA (US); Rafael Sayegh, Rancho Cucamonga, CA (US); Radim Hotovec, Ostrava-Muglinov (CZ); Vladimir Hotovec, Ostrava-Muglinov (CZ)

(73) Assignee: Universal Surveillance Systems, LLC, Rancho Cucamonga, CA (US)

( * ) Notice: Subject to any disclaimer, the term of this patent is extended or adjusted under 35 U.S.C. 154(b) by 84 days.

(21) Appl. No.: 13/869,725

(22) Filed: Apr. 24, 2013

(65) Prior Publication Data

US 2013/0278426 A1 Oct. 24, 2013

Related U.S. Application Data

(60) Provisional application No. 61/637,454, filed on Apr. 24, 2012.

(51) Int. Cl.
*G08B 13/24* (2006.01)

(52) U.S. Cl.
CPC ..... *G08B 13/246* (2013.01); *G08B 13/2474* (2013.01); *G08B 13/2485* (2013.01); *G08B 13/2488* (2013.01)

(58) Field of Classification Search
CPC .. G08B 13/2485; G08B 13/14; G08B 13/246; G08B 13/248; G08B 13/2411; G06K 15/00
USPC ..... 340/572.3, 572.4; 235/383, 385, 375, 235/382; 705/16, 20
See application file for complete search history.

(56) References Cited

U.S. PATENT DOCUMENTS

| | | | | |
|---|---|---|---|---|
| 4,509,039 | A * | 4/1985 | Dowdle | 340/572.7 |
| 5,699,046 | A * | 12/1997 | Accolla | G08B 13/2471 340/10.5 |
| 6,108,638 | A * | 8/2000 | Sato et al. | 705/21 |
| 7,242,300 | B1 * | 7/2007 | Konstad et al. | 340/568.5 |
| 2007/0034692 | A1 * | 2/2007 | Johnson | 235/383 |
| 2007/0084918 | A1 * | 4/2007 | Tabet et al. | 235/383 |
| 2009/0027202 | A1 * | 1/2009 | Copeland et al. | 340/572.1 |
| 2009/0101713 | A1 * | 4/2009 | Ulrich et al. | 235/383 |
| 2012/0280040 | A1 * | 11/2012 | Carney et al. | 235/383 |

* cited by examiner

*Primary Examiner* — Hung T Nguyen
(74) *Attorney, Agent, or Firm* — Milord A. Keshishian

(57) ABSTRACT

The present invention discloses a point of sale (POS) structure that is includes an Electronic Article Surveillance (EAS) system.

13 Claims, 15 Drawing Sheets

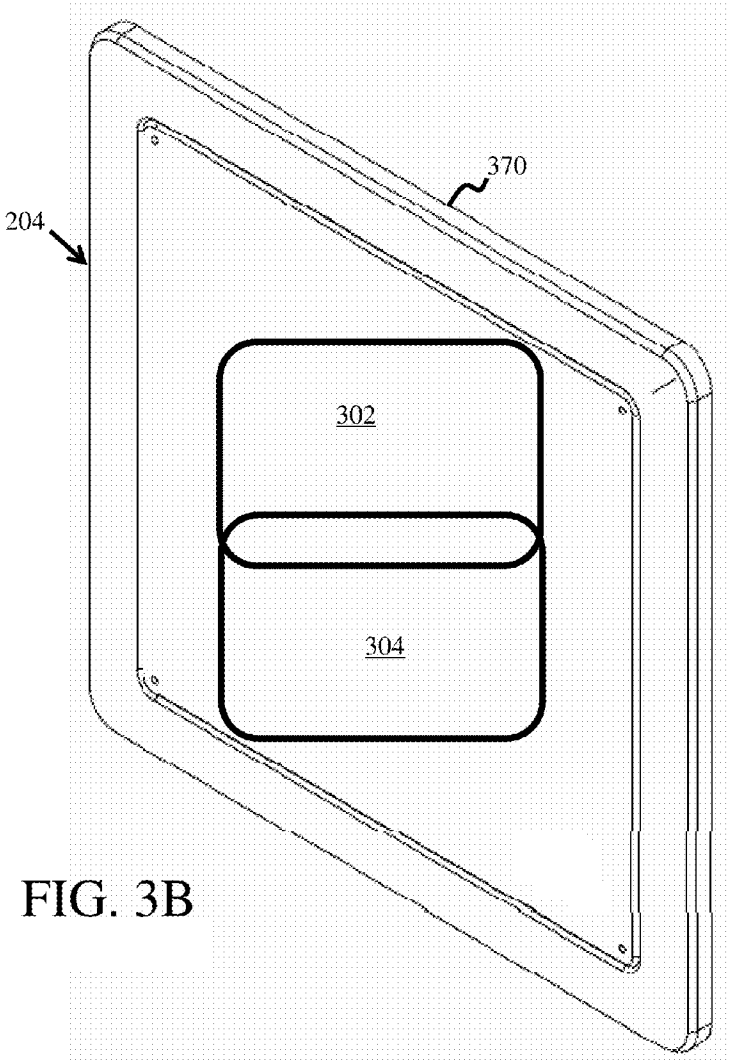
FIG. 3B
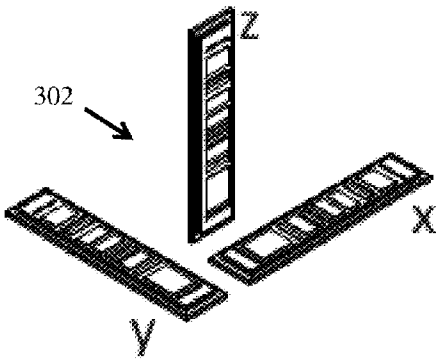

System operating, no tag

System operating with tag

System 1 operating with another System 2, no tag

System 1 operating with another System 2, tag on System 1

System operating with tag and jammer

ELECTRONIC ARTICLE SURVEILLANCE

CROSS-REFERENCE TO RELATED APPLICATIONS

This application claims the benefit of priority of the U.S. Provisional Utility Patent Application No. 61/637,454, filed Apr. 24, 2012, the entire disclosure of which is expressly incorporated by reference herein. Where a definition or use of a term in an incorporated reference is inconsistent or contrary to the definition of that term provided herein, the definition of that term provided herein applies and the definition of that term in the incorporated reference does not apply.

BACKGROUND OF THE INVENTION

1. Field of the Invention

This invention relates to article surveillance systems and, more particularly, to a point of sale (POS) electronic article surveillance (EAS) system.

2. Description of Related Art

Conventional EAS systems with EAS pedestal systems that are positioned at the ingress/egress locations of a retail store are well known have been used for a number of years. Regrettably, placement of the EAS pedestal systems only at the entry/exit location of retail stores does not provide a sufficient protection for the protected items. For example, as illustrated in FIG. 1, a shopper 102 may include hidden tagged merchandise 110*a* inside their clothing while including other merchandise inside a shopping cart 104. The shopper 102 may unintentionally place one or more small, EAS tagged items 110*b* at the bottom of the shopping cart 104, with several EAS larger items 110*c* at the top thereof. The shopper 102 may also intentionally hide smaller tagged items 110*d* within a EAS larger tagged item 110*c*. In either instance, the sales clerks may neutralize an EAS tag of the EAS larger tagged items 110*c* but without noticing the hidden EAS tagged item 110*a*, smaller EAS tagged items 110*b* at the bottom of the cart 606, or EAS tagged item 110*d* within the EAS larger tagged item 110*c*. In such an instance, shoppers pay for the scanned larger EAS tagged items 110*c*, but not the inconspicuous and intentionally hidden smaller items EAS tagged item 110*a*, EAS tagged item 110*b*, and or the EAS tagged item 110*d*. Of course, the EAS tagged smaller items 110*a*, 110*b*, and 110*d* not neutralized trigger an alarm when the shoppers 102 pass through the entry/exit EAS pedestals systems. However, in most instances, it is a general retail policy to not follow a shopper outside the retail store and in fact, in most cases the sales clerks are under the false impression that they have neutralized all tagged items correctly (as all visible tagged items were neutralized), and interpret the triggered alarm as a false alarm, allowing the shopper (who may be part of an organized retail crime) to simply exit the store without paying or processing the smaller EAS tagged items 110*a*, 110*b*, and 110*d*.

Accordingly, in light of the current state of the art and the drawbacks to current EAS systems, a need exists for an EAS system that would allow detection of EAS tagged items at a point of sale to thereby prevent shoplifting and organized retail crime.

BRIEF SUMMARY OF THE INVENTION

A non-limiting, exemplary aspect of an embodiment of the present invention provides a method for surveillance of articles, comprising:

generating an electronic article surveillance (EAS) field at a point of sale (POS) that defines a POS EAS surveillance zone;

detecting EAS tags associated with the articles that are within the generated POS EAS surveillance zone;

communicating existence of detected EAS tags at the POS with an indictor until the EAS tags at the POS are neutralized.

Another non-limiting, exemplary aspect of an embodiment of the present invention provides a security system, comprising:

a point of sale (POS) structure; and an Electronic Article Surveillance (EAS) system that is associated with the POS structure.

Still another non-limiting, exemplary aspect of an embodiment of the present invention provides a point of sale (POS) structure, comprising:

an Electronic Article Surveillance (EAS) system.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIGS. 3A to 3C are non-limiting, exemplary schematic illustrations of an EAS transceiver controller module of a POS EAS system in accordance with an embodiment of the present invention, including non-limiting, exemplary illustrations of EAS system antenna transmission patterns;

DETAILED DESCRIPTION OF THE INVENTION

Figure 1:
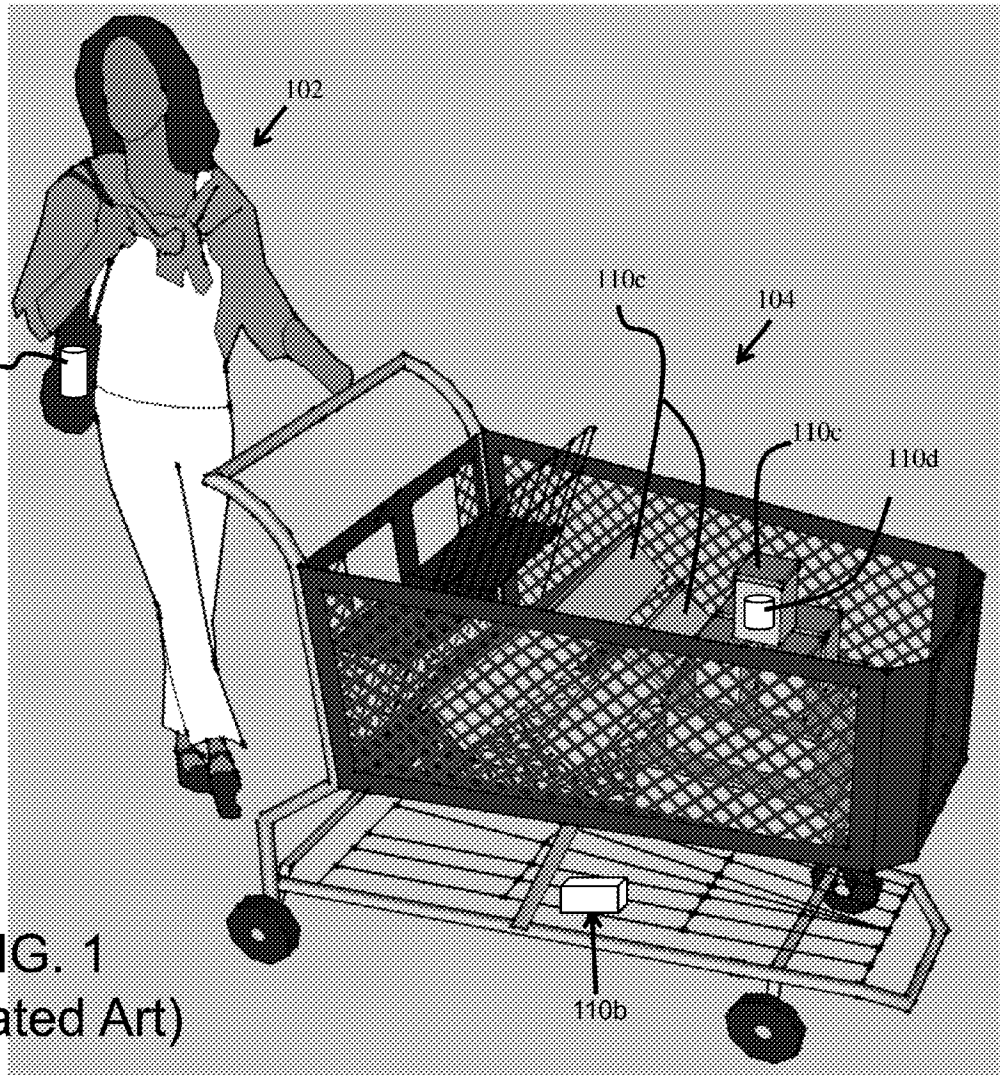
FIG. 1 (Related Art)
FIG. 1 is a non-limiting exemplary illustration of a shopper with a shopping cart, including EAS tagged items.

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. Further, each block within a flowchart may represent both method function(s), operation(s), or act(s) and one or more elements for performing the method function(s), operation(s), or act(s). In addition, depending upon the implementation, the corresponding one or more elements may be configured in hardware, software, firmware, or combinations thereof.

In the description given below and the corresponding set of drawing figures, when it is necessary to distinguish the various members, elements, sections/portions, components, or any other aspects (functional or otherwise) or features of a device(s) or method(s) from each other, the description and the corresponding drawing figures may follow reference numbers with a small alphabet character such as (for example) "EAS tagged items 110*a*, 110*b*, 110*c*, 110*d*, and etc." If the description is common to all of the various members, elements, sections/portions, components, or any other aspects (functional or otherwise) or features of a device (s) or method(s) such as (for example) to all EAS tagged items 110*a*, 110*b*, 110*c*, 110*d*, and etc., then they may simply be referred to with reference number only and with no alphabet character such as (for example) "EAS tagged item 110."

Throughout the disclosure, a "structure" may refer to any one or combination of fixture, display, furniture, shelves, cabinetry, etc., such as a checkout counter, cash wrap, table, and so on.

Further, phrases such as "point of sale" (POS), "point of transaction" (POT) or the like generally refer to a specific location (that may or may not include a "structure") where (or at which point or location) a transaction is completed. Throughout disclosure the terms POS or POT are deemed equivalent and interchangeable.

A point of sale (POS) system is generally referred to one or more machines that facilitate transactions at the POS. Non-limiting examples of POS systems may include computerized systems, networked cash registers, barcode reader, card reader, etc. that are generally located at the point of sale.

Throughout the disclosure, references to any one or more specific types of security Electronic Article Surveillance (EAS) systems are meant as illustrative, for convenience of example only, and should not be limiting. Non-limiting, non-exhaustive listings of examples of EAS systems that may be used with any one or more embodiments of the present invention may include Electromagnetic (EM) EAS systems, Radio Frequency (RF) EAS systems, Acousto-magnetic (AM) EAS systems, Microwave (MW) EAS system, etc., or any combinations thereof.

The present invention provides a very small and compact POS EAS system that is inconspicuously associated with a conventional POS structure that allows for seamless processing and detection of articles at the POS. That is, articles with EAS tags are seamlessly detected and processed at the POS prior to entry of the EAS tagged articles (if any) to within the detection zone of EAS pedestal systems, which are conventionally located at ingress/egress retail locations. The small, compact form of the POS EAS system of one or more embodiments of the present invention allows for inconspicuous mechanical integration thereof with most conventional POS structures without modifying the exterior "look and feel" of the POS structure or taking additional space at or near the POS location of a typical retail store.

Figure 2A:
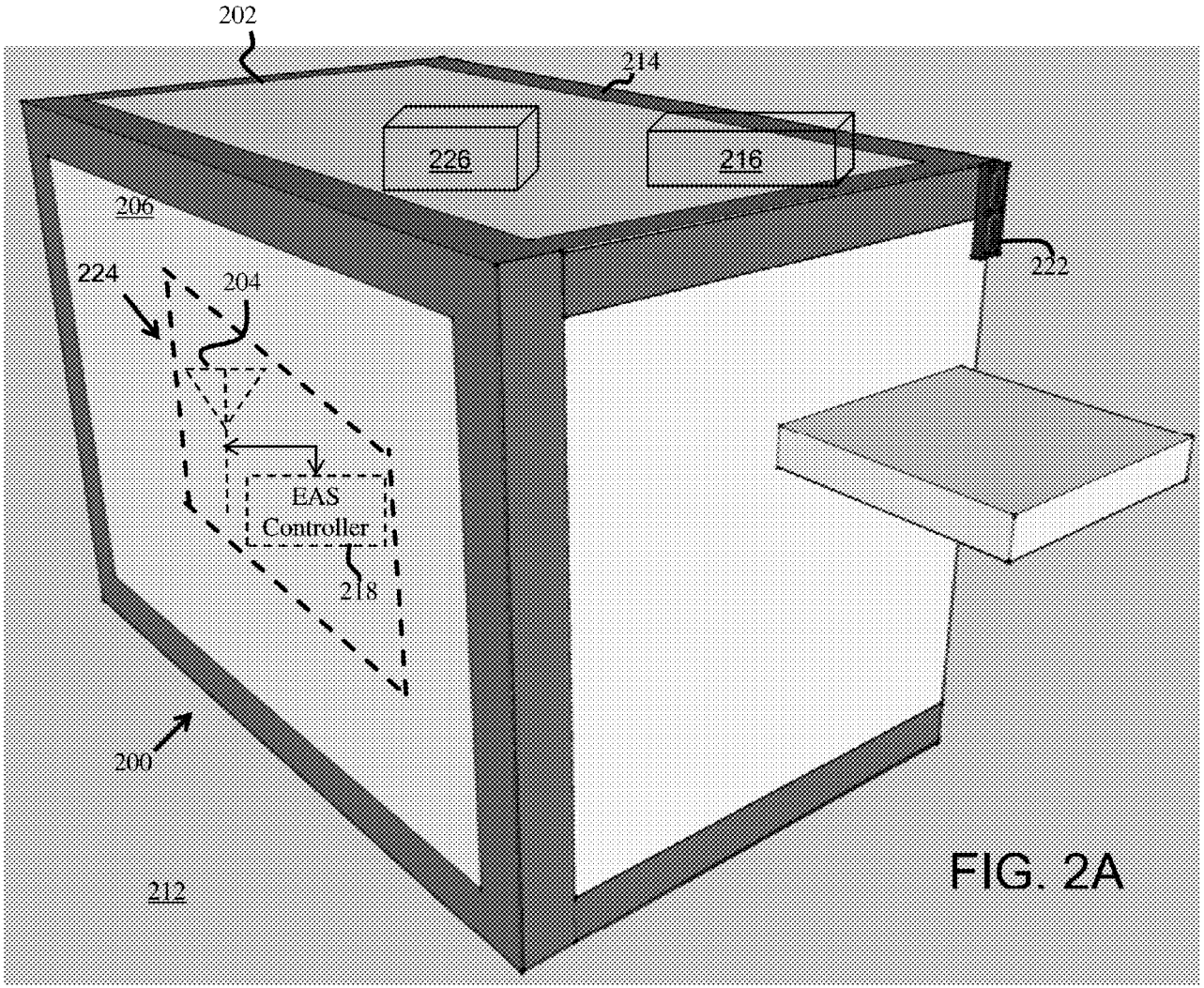
FIGS. 2A and 2B are a non-limiting, exemplary illustration of a POS EAS system in accordance with an embodiment of the present invention.
Figure 2B:
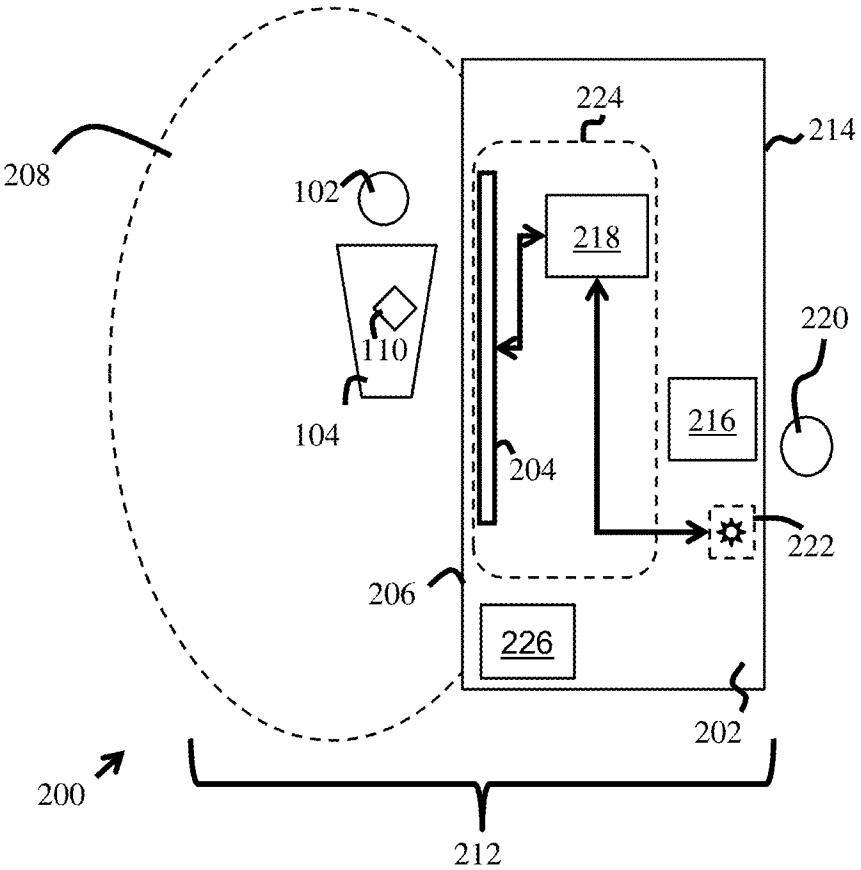

FIGS. 2A and 2B are a non-limiting, exemplary illustration of a POS EAS system in accordance with an embodiment of the present invention. As illustrated in FIGS. 2A and 2B, the security system of the present invention is the POS EAS system 200 that is comprised of a POS structure 202 that includes an EAS system 224. Accordingly, with the POS EAS system 200 of the present invention, when the shopper 102 (shown in FIG. 1) approaches within the vicinity of the POS structure 202, the associated EAS system 224 immediately detects all EAS tags 110 of the items that are on the shopper 102 or carried by the shopper 102 via the shopping cart 104 into a POS EAS surveillance zone 208. The detection of all EAS tags 110 is continuously and discretely communicated with a sales clerk 220 via an inconspicuously positioned indicator alarm 222. The indicator alarm 222 is continuously driven and maintained in a first mode of operation (e.g., a visual indicator alarm having red color light as "EAS tag detected") as a result of existence of EAS tags 110 within the POS EAS surveillance zone 208 until all of the EAS tags 110 at the POS structure 202 are neutralized at which point, the indicator alarm 222 is continuously driven and maintained in a second mode of operation (e.g., the visible indicator alarm 222 having a green color light as "EAS tag not detected").

With an embodiment of the present invention, the sales clerks 220 seamlessly proceed processing the EAS tagged items 110 at the POS 212 in a well known and conventional manner, including neutralizing each visible EAS tag of all visible EAS tagged items 110 using conventional EAS tag deactivator 216, but without noticing (or even knowing about) the hidden EAS tagged item 110*a* on the shopper 102, the smaller EAS tagged items 110*b* at the bottom of the cart 104, or the EAS tagged item 110*d* within the larger, visible EAS tagged item 110*c* (all shown in FIG. 1).

Upon processing (e.g., neutralizing) all visible EAS tagged items 110 in a well known and conventional manner using the EAS tag deactivator 216, and prior to finalizing the transaction (e.g., using a POS system 226), the sales clerk 220 then checks the indicator alarm 222 to determine the continued existence of EAS tagged items 110 within the vicinity of the POS structure 202. In the present instance, with the shopper 102 having hidden EAS tagged items 110, the sales clerk 220 is discretely informed by the indicator alarm 222 about the continued presences or existence of EAS tagged items 110 (with the indicator 222 operating in the first mode of operation) at which time, the sales clerk 220 may simply follow retail store policy, for example, informing a manager about continued existence of non-visible or non-viewable (or hidden) EAS tagged items 110 at the POS 212 before finalizing the transaction. Therefore, with the present invention, the sales clerks 220 are no longer under the false impression that they have neutralized all EAS tagged items 110 correctly just because they see no other visible EAS tagged item 110 that is visible, and would no longer allow a shopper to simply exit the store without paying or processing all EAS tagged items 110 at the POS 212.

As further illustrated in FIGS. 2A and 2B, one or more embodiments of the present invention provide the EAS system 224, one or more components of which may be associated with the POS structure 202, forming the POS EAS system 200. More specifically, one or more preferred embodiments of the present invention provide one or more EAS antenna systems 204 (of the EAS system 224) that are mechanically integrated (physically connected) with the POS structure 202.

In general, it is preferred that the EAS antenna system 204 is inconspicuously associated with the POS structure 202, and positioned at a transaction side 206 of the POS structure 102 closest to where an actual POS transaction is conducted rather than the transaction processing side 214 (closest to the sales clerks 220). The placement of the EAS antenna system 204 at the transaction side 206 of the POS structure 202 enables the EAS antenna system 204 to generate an EAS field at the POS that defines the POS EAS surveillance zone 208 for detection of EAS tagged items 110 within the POS EAS surveillance zone 208. Further, it should be noted that if the EAS antenna system 204 is mounted onto a metal POS structure, the antenna housing is generally and preferably positioned slightly away or distance from the body of the metal POS structure to avoid potential flux interferences.

As further illustrated in FIGS. 2A and 2B and described above, the EAS system 224 discreetly communicates with the indicator alarm 222, which is inconspicuously associated with the POS structure 202 and is positioned at the transaction processing side 214 of the POS structure 202 to be clearly viewable by the sales clerks 220. In general, the indicator alarm 222 is continuously driven and maintained in the first mode of operation as a result of existence of EAS tagged items 110 within the POS EAS surveillance zone 208 until the EAS tagged items 110 at the POS are neutralized at which point, the indicator alarm 222 is continuously driven and maintained in a second mode of operation. The indicator alarm 222 may be an audio indicator, a visual indicator, and or an audio-visual indicator that may be coupled with (or plugged into) an EAS system controller module 218.

Figure 3A:
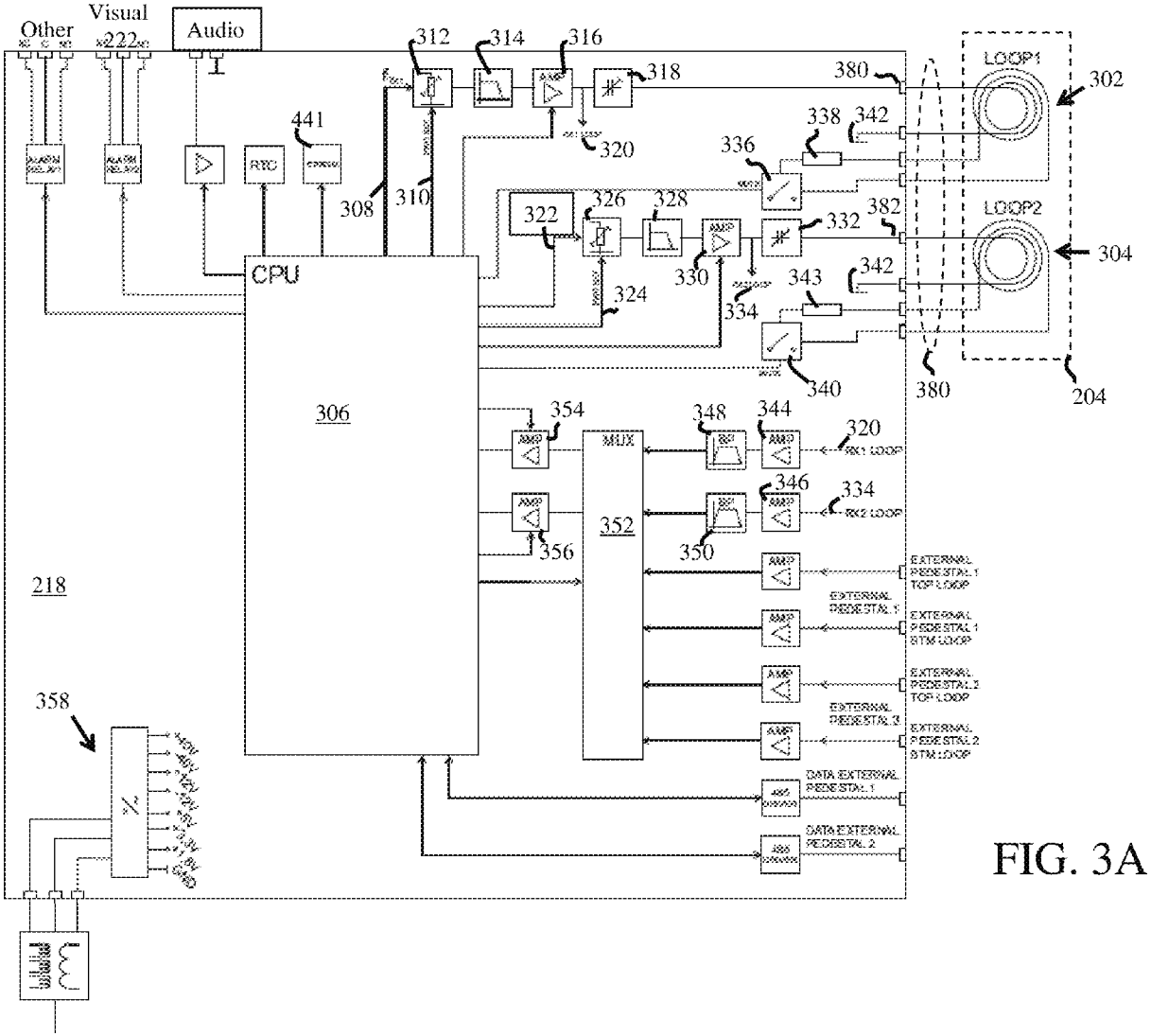
Figure 3C:
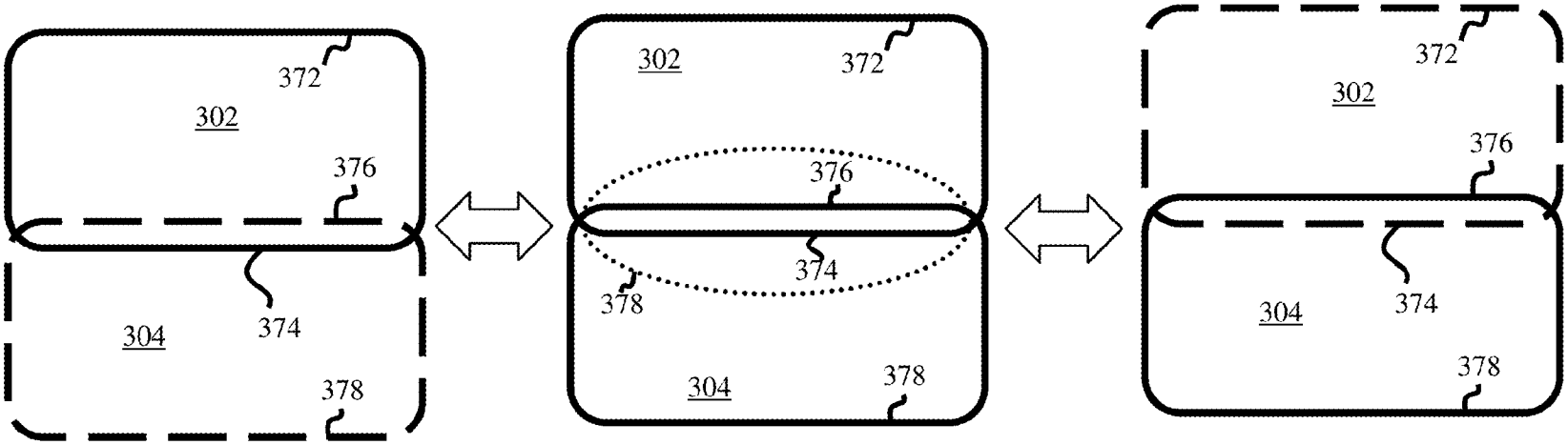

FIGS. 3A to 3C are non-limiting, exemplary schematic illustrations of an EAS transceiver controller module of a POS EAS system in accordance with an embodiment of the present invention, including illustrations of EAS system antenna transmission patterns. As illustrated in FIGS. 3A to 3C, the POS EAS system 200 includes an EAS transceiver controller module 218 that couples with the EAS antenna system 204 for controlling the EAS antenna system 204. The EAS antenna system 204 may be coupled with the EAS transceiver controller module 218 by cables 380 to provide a simple "plug & play" EAS system 224. It should be noted that FIGS. 3A to 3D schematically illustrate an Acousto-Magnetic (AM) EAS system 224 for discussion purposes only and therefore, should not be limiting.

The AM the EAS system 224 illustrated in FIGS. 3A to 3C includes the EAS transceiver antenna system 204 that is comprised of a first inductor coil 302 and a second inductor coil 304, with the EAS transceiver controller module 218 coupled with both the first and the second inductor coils 302 and 304. As best illustrated in FIGS. 3B and 3C, the first inductor coil 302 and the second inductor coil 304 are accommodated within an antenna housing 370, and associated with the transaction side 206 of the POS structure 202.

The first inductor coil 302 forms an upper loop of the transceiver antenna 204 with substantially rectangular curved corners, and the second inductor coil 304 forms a lower loop of the transceiver antenna 204 with substantially rectangular curved corners. The first and second inductor coils 302 and 304 are mutually arranged and positioned to minimize (or eliminate) flux interferences while maintaining their respective independent and autonomous operational principles. Accordingly, the mutual arrangement, orientation, and actual physical positioning of the first and second loops 302 and 304 within a shared space of the antenna housing 370 is configured to achieve minimal flux interference, which enables the transmission of EAS surveillance signals in the desired pattern (detailed below) with no induced current in the inductor coil 302 or 304 which is not actuated (detailed below).

As further illustrated in FIGS. 3B and 3C, a bottom portion 374 of the upper loop 302 overlaps a top portion 376 of the lower loop 304. This overlapping arrangement of the antenna loops 302 and 304 is preferred as the overall size of the antenna 204 is reduced by the overlapping span and hence, the antenna system 204 takes less space, allowing for an easy fit within most POS structures 202. Accordingly, the antenna loops 302 and 304 are parallel and in common plane in relationship to one another, with the overlapping portions that touch. However, it should be noted that the bottom portion 374 of the upper loop 302 may also be positioned a specific distance away from a top portion 376 of the lower loop 304 where no overlap occurs. The specific distance desired is determined and is based on many factors, non-limiting examples of which may include loop size, number of loops, the magnetic flux generated, etc. Accordingly, if space is not of concern, then the loops 302 and 304 need not be overlapped without change in the operation of the POS EAS system 200.

As illustrated in FIGS. 3B and 3C, an embodiment of the present invention uses two antenna loops 302 and 304 in combination with a specific transmission pattern (detailed below and illustrated in FIG. 3C) to detect an EAS tag 302 that is positioned or placed within the POS EAS surveillance zone 208 at any orientation to thereby eliminate potential detection-holes or "blind-spots." In FIG. 3C, solid lines are used to indicate active or transmitting antenna loops and dashed lines are used to indicate non-active or non-transmitting antenna loops. Further, the indicated pattern of activating any one or both antenna loops 302 and 304 need not be in any particular order or sequence. For example, the pattern of activation may start with activating the second antenna loop 304, then the first and the second antenna loops 302 and 304 together as indicated, and finally the first antenna loop 302. Alternatively, antenna loop activation pattern may start with the first antenna loop 302, then the second antenna loop 304, and finally the activation of both the first and the second antenna loops 302 and 304. As another example, antenna loop activation pattern may start with activation of both the first and the second antenna loops 302 and 304 first, and then individual activation of the antenna loops 302 and 304. Accordingly, any permutation of the illustrated activation scheme is possible so long as the antenna loops 302 and 304 are activated individually as illustrated and also activated together as illustrated, representing a full cycle.

As best illustrated in FIGS. 3A to 3C, the transceiver controller module 218 in a transmitter mode of operation (under the control of a Central Processing Unit (CPU) 306) may drive the first inductor coil 302 to generate a first transmission signal in a form of a first magnetic field. The first drive signal (the current) through the first or upper loop 302 generates a first magnetic field that is best suited for detection of EAS tags 110 in the Z-orientation and in particular, the detection is best at the upper and lower horizontal portions 372 and 374 of the upper loop 302 to detect EAS tags 110 in the Z-orientation.

It should be noted that since the EAS system 224 (including the controller module 218 and the antenna system 204) operates as a transceiver system, after every single transmission, the CPU 306 switches the mode of operation of the EAS transceiver controller module 218 and the transceiver antenna system 204 from the transmitter mode of operation to a receiver mode of operation. Accordingly, once a transmission signal is transmitted (e.g., the first transmission signal via the first inductor coil 302), the CPU 306 switches the mode of operation of the EAS system 224 from transmitter to the receiver mode of operation after a short delay (which enables the transmission of an already transmitted signal to be completed).

In a receiver mode of operation, the transceiver controller module 218 receives detected EAS signals of EAS tags 110 within the POS EAS surveillance zone 208 through both the first and second inductor coils 302 and 304 of the transceiver antenna system 204 (which operate as receiver antenna loops when in the receiver mode of operation). The received EAS signal from the POS EAS surveillance zone 208 is then stored for further processing by the transceiver control module 218 after which, the transceiver control module 218 (under the control of the CPU 306) switches back to transmitter mode of operation to transmit another transmission signal. The back and forth switch between the transmitter mode of operation and the receiver mode of operation continues until a fully cycle of the transmitter pattern of the antenna loops 302 and 304 (shown in FIG. 3C) in the transmitter mode of operation is complete, with all the EAS signals detected during the receiver mode of operation stored for later processing by the transceiver controller module 218.

In particular, after driving the first inductor coil 302 to generate a first transmission signal in a form of a first magnetic field, switching back to the receiver mode of operation after a short delay to receive potential EAS tag 110 signals, and storing the EAS tag signals (if any), the transceiver controller module 218 switches back to the transmitter mode of operation to drive the second inductor coil 304 to generate a second transmission signal in a form of a second magnetic field. The current through the lower loop 304 generates a magnetic field best suited for detection of EAS tags 110 in the Z-orientation, in particular, the detection is best at the upper and lower horizontal portions 376 and 378 of the lower loop 304 to detect EAS tags in the Z-orientation. It should be noted that the combination of the active upper loop 302 only and active lower loop 304 only provides full detection along all orientation, with the first and second magnetic fields defining a complete POS EAS surveillance zone. However, it has been found that detection of EAS tags 110 in the X-Y orientation is weaker when using only the first generated magnetic field and only the second generated magnetic field. Accordingly the transceiver controller module 218 in the transmitter mode of operation further drives both the first and the second inductor coils 302 and 304 together and in phase to generate both the first transmission signal and the second transmission signal in phase, forming a third transmission signal in a form of a third magnetic field. The current through the first and the second inductor coils 302 and 304 are in the same direction (in phase), generating the third magnetic field (along the dotted area 378) best suited for detection of EAS tags 110 in the X-Y-orientation. The first, second, and third magnetic fields more optimally define the POS EAS surveillance zone 208.

As indicated above, the transceiver control module 218 is switched to a receiver mode of operation (after a short delay) after transmitting any one of the first, second, and third transmission signals after which, the transceiver control module 218 is switched back to transmitter mode of operation to transmit another one of the first, second, and third transmission signals.

Referring back to FIG. 3A, the transceiver controller module 218 includes a power pack (with a step-down transformer) 358 for powering the EAS system 224, including the transceiver controller module 218 and the EAS transceiver antennas 204. The CPU 306 generates the one or more drive signals (which are digital signals at a desired frequency) through a first transmit signal line 308, a second transmit signal line 322, or both the first and the second transmit signal lines 308 and 322 to respectively drive the first inductor loop 302, the second inductor loop 304, or both the first and second inductor loop 302 and 304. Accordingly, as an example, to energize the first inductor loop 302 only, the CPU generates the desired drive signal for that loop through the first transmit signal line 308 only, with no drive signal on the second transmit signal line 322. The drive signals through the first transmitter signal line 308 and the second transmitter signal line 322 may have the same frequency with either the same or different phases. In particular, an embodiment of the present invention provides drive signals that have the same frequency but opposite phases when activating both the first inductor loop 302 and the second inductor loop 304 together (shown in FIG. 3C). The frequency used (e.g., about 58 KHz) may be commensurate with the type of EAS system used (e.g., AM EAS system).

The EAS transceiver controller module 218 further includes digital potentiometer 312 and 326, which are digitally controlled variable resistors that are controlled by the CPU 306 via the PWR SET pin signal line 310 and 324 to control the magnitude of the power of the respective digital drive signals output from the first transmitter signal line 308 and the second transmitter signal line 322. A set of transmit low pass filters 314 and 328 converts the drive signals output from the digital potentiometers 312 and 326 into an analogy signals with desired frequency. The analog signals are then amplified by a set of transmit amplifier 316 and 330, respective outputs of which are input to a set bank of matching capacitors 318 and 332 that in combination with the first and second antenna loops 302 and 304 of the AM EAS transceiver antenna system 204 form an LC circuit that is tuned to resonate at a desired resonant frequency (e.g., 58 KHz), to generate AM acousto magnetic pulses. Accordingly, the first bank of capacitors 318 is coupled to a first end 380 of the first inductor loop 302, with a second end of the first inductor loop 302 coupled with ground 342. The second bank of capacitors 332 is coupled to a first end 382 of the second inductor loop 304, with a second end of the second inductor loop 302 coupled with ground 342.

As indicated above, the transceiver controller module 218 has a transmitter mode of operation and a receiver mode of operation, which enable the EAS antenna system 204 to transmit signals at desired resonating frequency, and receive EAS signals at a desired resonating frequency. As further indicated above, the transceiver controller module 218 switches to the receiver mode of operation after every single transmission within a specified period (or a window of time). This time period allows the transmission of a single to be completed prior to a delay period and switching to the receiver mode of operation. However, depending on the quality (or Q factor) of the LC resonating circuit (the inductor loops 302 or 304 and the respective bank of capacitors 318 or 332), the frequency of oscillation between the inductor loop (302 or 304) and the respective bank of capacitors (318 or 332) may have a longer duration than the specified period required for switching from transmitter mode of operation to a receiver mode of operation. Accordingly, the transceiver controller module 218 includes a set of switch mechanisms 336 and 340 that when closed, in conjunction with respective resistors 338 and 343, eliminate further resonance of the EAS antenna system 204 during transmitter mode of operation and thereby, prevent further induced oscillation in the EAS antenna system 204 caused by an AM pulse transmissions. In other words, the switches 336 and 340 when closed, do not allow further transmission of any legacy resonance ("ring down signal") to extend beyond the allotted transmission time and into the delay period prior to the transceiver controller module 218 switching to the receiver mode of operation.

As further indicated above, in the receiver mode of operation, the transceiver controller module 218 receives EAS signals of EAS tags 110 that may be within the POS EAS surveillance zone 208 through both the first and second inductor coils 302 and 304 of the transceiver antenna 204. The received EAS signals (indicated at 320 and 334 are amplified (via amplifiers 344 and 346), filtered (via band-pass filters 348 and 350), multiplexed (via a multiplexer 352), and amplified (via a second amplifier set 354 and 356), and input to an A/D converter of the CPU 306 for processing the received EAS signals. The processing of the received EAS signals by the CPU 306 is similar in the manner that is fully disclosed and described in the U.S. Patent Application Publication 2011/0304458 to Sayegh et al., the entire disclosure of which is expressly incorporated by reference herein.

Figure 4A:
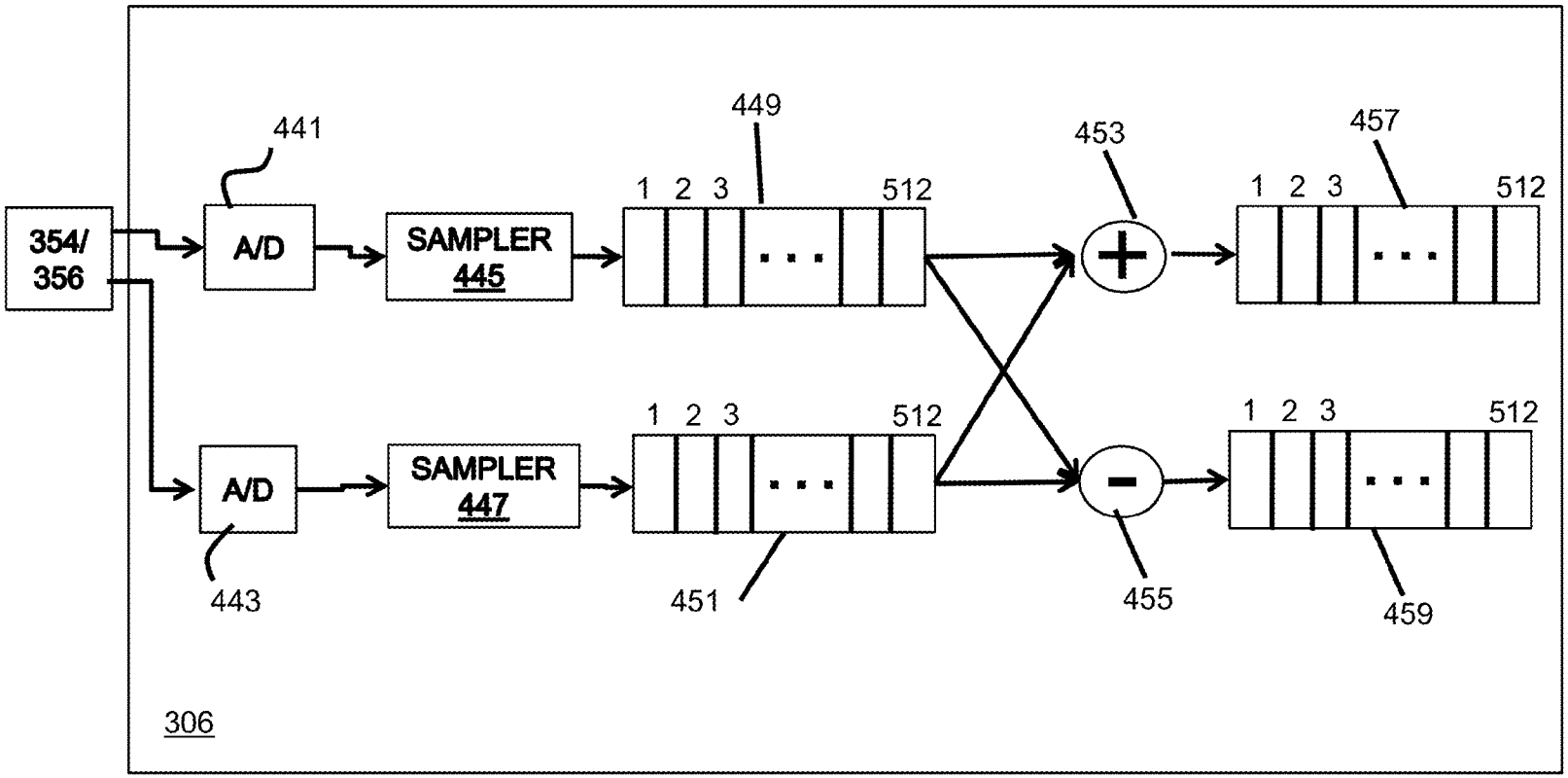
FIG. 4A is non-limiting, exemplary illustration of the internal signal processing of received signals in accordance with the present invention.

FIG. 4A is an exemplary illustration of the signal processing of the received signals from the amplifiers 354/356 by the CPU 306. As has been described above, the transmitter field phase relationship for the transmitting antennas of the acousto-magnetic EAS system 224 is selected during the installation process and maintained substantially constant thereafter during operation. As is well-known, at least theoretically, it is possible for a tag or a marker to pass through a surveillance zone that is generated as a result of transmitted signal with constant phase and not be detected due to the tag orientation within the surveillance zone. Therefore, theoretically, the possibility exists that a tag or marker may not be detected due to its orientation within a surveillance zone that is generated or created from a substantially constant phase signal and hence, resulting in "detection holes" within the surveillance zone. The signal processing by the CPU 306 illustrated in FIG. 4A obviates the possible occurrence of an undetected tag within the surveillance zone that is generated by a signal with a constant phase. The CPU 306 signal processing illustrated in FIG. 4A includes manipulation of digitized signal values input from the dual output channel of the voltage control amplifier 354/356 to compute in-phase and out of phase relationship between the received signals from the receiver antenna loops of a receiver pedestal to thereby detect any tag orientation and eliminate possible detection holes within the surveillance zone.

As illustrated FIG. 4A, the CPU 306 includes Analog-to-Digital (A/D) converts 441 and 443 that convert analog signals from the dual output channel of the voltage control amplifier 354/356 to digital signals for further signal processing. The digitized signals are then simultaneously sampled by respective sampler unit 445 for first inductor coil (loop 302) and sampler unit 447 for the second inductor coil (loop 304). The sampling rate is at about N times the frequency of operation of the antennas per unit of time. For example, for most acousto-magnetic EAS systems the frequency of operation of transmitted signals is about 58 KHz. Therefore, in this exemplary non-limiting instance, the sample rate N would be 4×58 KHz or 232 Kilo-samples per second or 232,000 samples per second. The CPU 306 then stores M number of such samples into the respective antenna array samples 449 and 451. That is, M digitized sampled signals for first inductor coil (loop 302) from the sampler 445 are stored in the antenna array sample 449, and M digitized sampled signals for second inductor coil (loop 304) from the sampler 447 are stored in the antenna array sample 451. The selection of the number of samples M to be stored depends on the array size selected. That is, the numeric value of M is commensurate with the size of the array. In this non-limiting exemplary instance, the sizes of the arrays 449 and 451 are 512 units and hence, 512 samples are selected from each sampler, and stored in the respective antenna array samples 449 and 451. The CPU 306 then adds those M samples from the arrays 449 and 451 via an ADDER 453 to compute in phase signal values (the so-called "0" configuration) and stores values in the in-phase or "O" configuration array 457, and subtracts the same via a SUBTRACT function 455 to compute the out of phase signal values (the so-called "8" configuration) and stores the results in the out of phase or "8" configuration array 459. The computed in-phase and out of phase relationship between the received signals from the receiver antenna loops of a receiver pedestal are then used (analyzed) to determine a detection of a tag or marker (regardless of any tag orientation), eliminating any possible detection holes within the surveillance zone.

As will be apparent from the flowcharts illustrated in FIGS. 4B and 4C and the timing and signal analysis graphs of FIGS. 4D to 4I (all of which are described in detail below), the operational or functional acts of the CPU 306 to sample, store, and compute the "O" and "8" configurations on received data is performed twice at predetermined reserved time periods. That is, sampling, storage, and computing is performed at a first predetermined reserved time when CPU 306 is timed or clocked to receive data from the tag, which is exemplarily illustrated at the predetermined reserved time period t3 shown in FIG. 4D, with the actual operational functional act exemplarily shown in FIG. 4B as the operational act 454. The second predetermined reserved time for the second sampling, storage, and computing is performed when the CPU 306 is timed or clocked to receive ambient or background noise (i.e., the CPU 306 is not expected to receive tag signal at this reserved time period), which is exemplarily illustrated at the predetermined reserved time period t5 shown in FIG. 4D, with the actual operational functional act exemplarily shown in FIG. 4B as the operational act 460. Stated otherwise, the results of the operational act 454 are data for "O" and "8" configurations in the respective arrays 457 and 459 that relate to the data from a tag (timed to receive at t3), and the results of the operational act 460 are data for "O" and "8" configurations in the respective arrays 457 and 459 from environmental signal (timed to receive at t5). It should be noted that it is only for clarity and convince that only a limited number of arrays are illustrated. In fact, the present invention uses a large number of arrays (or a plurality of arrays) to store all signal information for the many cycles of the operational acts 456 and 462 (including operational acts 465 and 467) in FIG. 4B. In addition, as illustrated in FIG. 3A, the CPU 306 includes one or more internal and external memory to store further signaling and programming information. Non-limiting examples of such memory may include the illustrated Random Access Memory RAM or Electrically Erasable Programmable Read-Only Memory EEPROM 441.

Figure 4B:
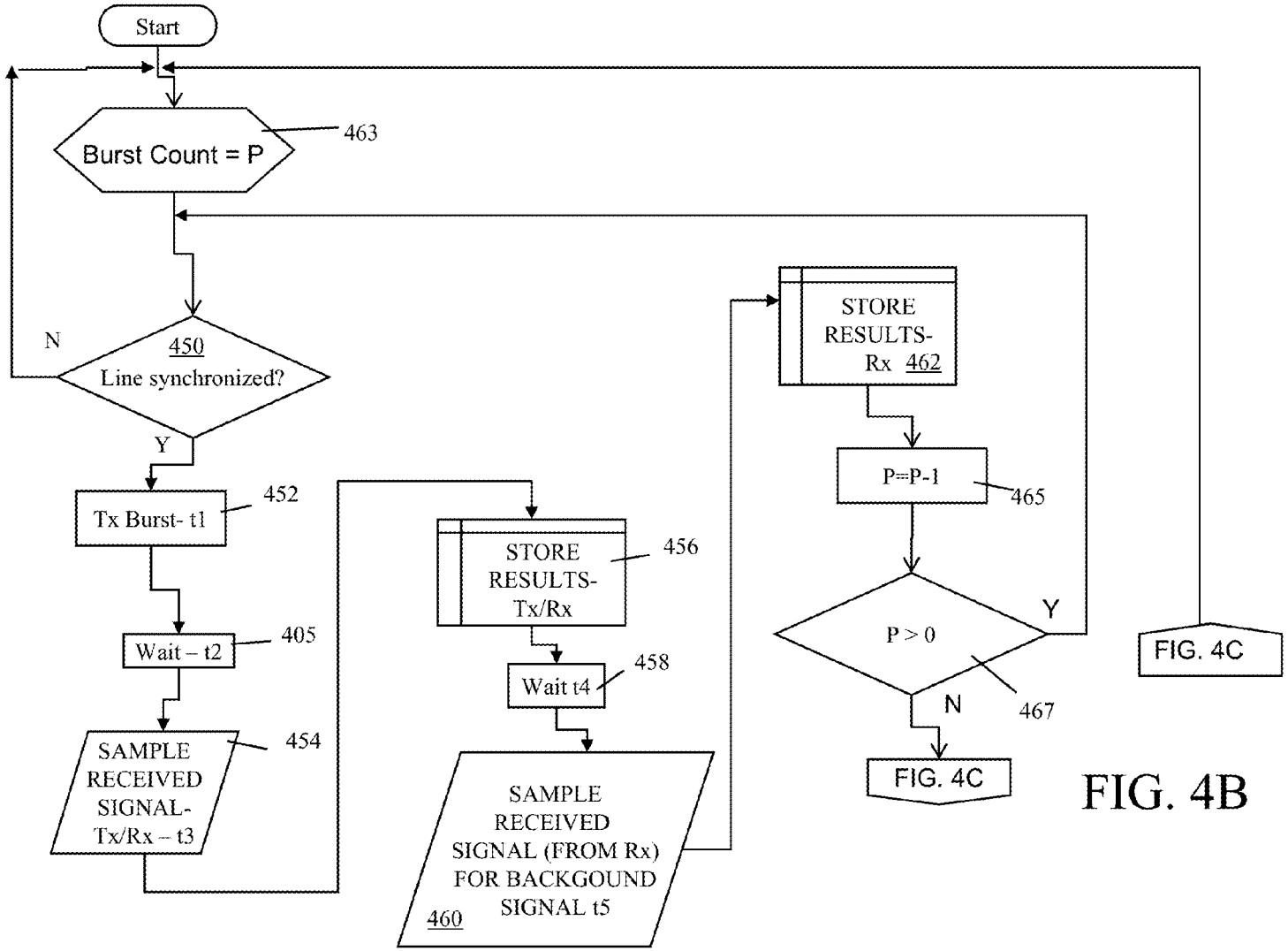
FIGS. 4B and 4C are non-limiting, exemplary schematic flowchart diagrams for the processing of antenna signals from an acousto-magnetic EAS system by a microprocessor in accordance with the present invention.
Figure 4C:
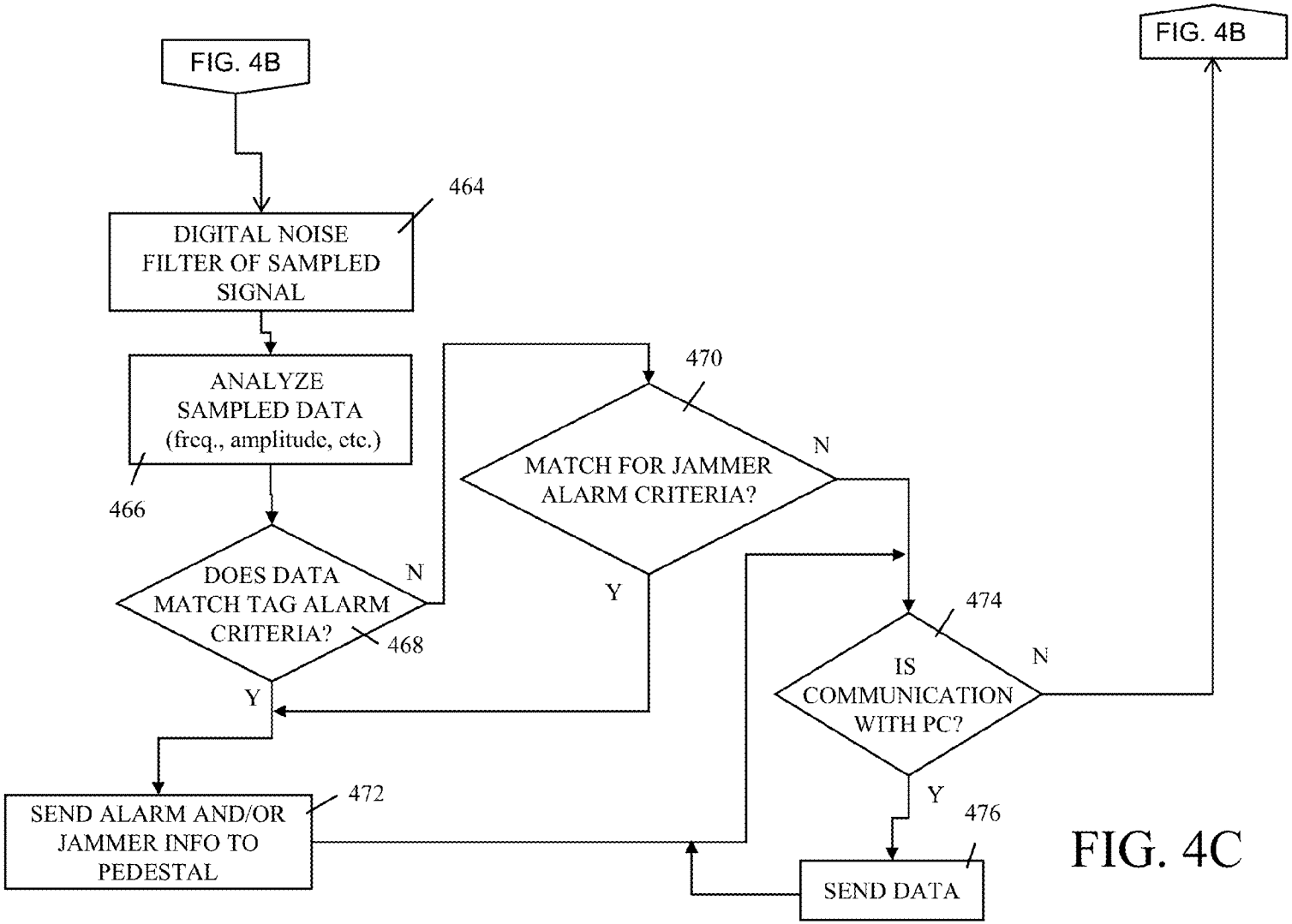

FIGS. 4B and 4C are exemplary illustrations of the flowcharts of the operational functional acts of the computer or CPU 306 in accordance with the present invention, and FIGS. 4D to 4I are exemplary illustrations of the timing and signal analysis graphs of the acousto-magnetic EAS system of the present invention. As is well known, in general, most acousto-magnetic EAS systems operate at a frequency of about 58.4 KHz, and transmit signals in bursts. Conventional acousto-magnetic EAS systems transmit signals at a normal rate but double the transmission rate (double the number of signal bursts) upon detection of a tag. The present invention transmits signals at a substantially constant burst rate "P." That is, the present invention transmits signals at "P" bursts per unit of time and maintains this transmission rate. Accordingly, as illustrated in FIG. 4B, at the operational act 463, the CPU 306 is prepared by setting the transmission signal burst count to some value "P." In this non-limiting exemplary instance, the Burst Count may be set to transmit signals at P=6 burst pulses, with each burst pulse having 1.6 millisecond (ms) duration, and with each burst pulse separated by 11.1 ms (if power supply frequency is at 60 Hz). In other words, in the non-limiting exemplary instance where Burst Count P is set to equal the numeric value 6 at the operational act 463, the operational acts 450 to 462 (including 465 and 467) are executed six times, prior to the commencement of the execution of the operational acts of 464 to 474 that are illustrated in FIG. 4C. After "P" execution cycles of operational acts 450 to 462 (including 465 and 467) shown in FIG. 4B, the operational acts 464 to 474 (shown in FIG. 4C) are then executed. In this non-limiting exemplary instance, the CPU 306 is allotted about 20 ms to execute the operational acts 464 to 474 (shown in FIG. 4C). Stated other wise, the CPU 306 of the system 400 of the present invention waits for about 20 ms before resetting the Bust Count P to a selected value. Accordingly, unlike the conventional acousto-magnetic systems that vary the rate of transmission signal bursts based upon the type of received signal, the present invention sets and maintains the rate of transmission signal bursts. As stated above, all data gathered throughout each of the "P" cycles are stored in a plurality of arrays (or memory), such as those illustrated in FIG. 4A (only two arrays are illustrated for clarity).

Figure 4D:
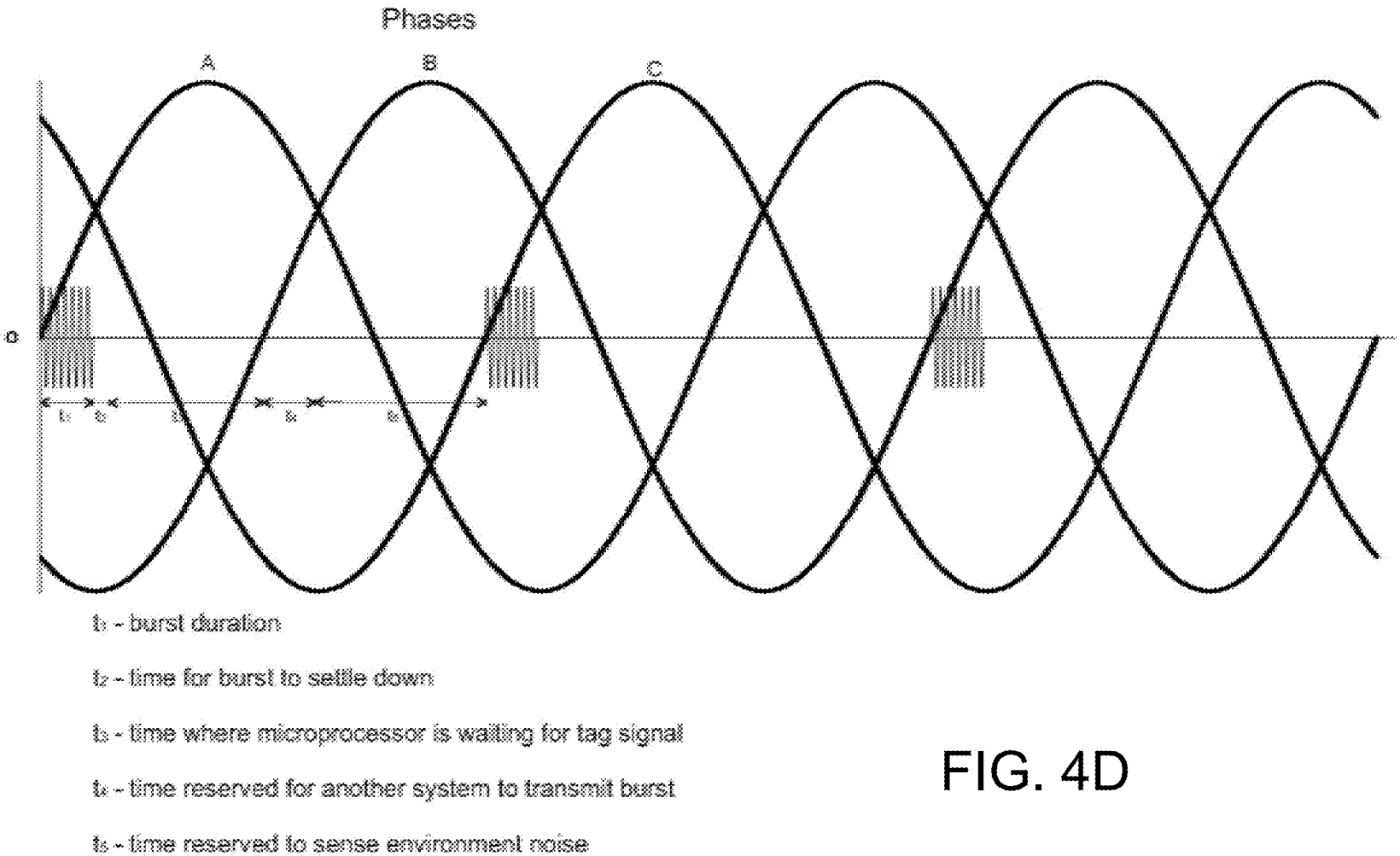
FIGS. 4D to 4I are non-limiting, exemplary schematic signal graphs of antenna signals of an acousto-magnetic EAS system, including signal analysis, timing, and illustration of ant-jamming method in accordance with the present invention.

As best illustrated in FIGS. 4B and 4C, and 4D, at the operational act 450 the input lines at exemplary phase lines A, B, and C illustrated in FIG. 4D are synchronized, and as part of the synchronization, the transmission from the transmitter TX1 is performed at the exemplary zero-crossing of the phase lines. It should be noted that synchronization of the transmission signals are done so to not interfere with one another and for appropriate reading of tag and noise signals. For example, a first system in one physical location functioning on phase line A must be synchronized such that no other signal is transmitted simultaneously by a second, different system functioning (for example) on phase line C at another, nearby physical location. As a further example, the start of a transmission of the signal pulse is synchronized to start at a zero-crossing, for example, at the start of time T1 for the duration of t1 for phase line A, or end of time t5 (for another system on phase line C). Once all timings for all signals are synchronized, at the operational act 452 a first signal pulse burst Tx with duration of t1 is transmitted (FIGS. 4G and 4H) at time T1 via the transmitter pedestal TX1. It should be noted that for systems that require a further delay in synchronization, after the operational act 452, an optional delay of Δ1 can be interjected so that t1 does not commence at the exemplary start of the zero-crossing, but is shifted (delayed) by some time Δ1.

All times are described as follows in relation to FIGS. 4D to 4I. As best illustrated in FIG. 4D, t1 is the pulse duration (operational act 452 in FIG. 4B) and t2 is the settlement phase or period of the pulse (operational act 405 in FIG. 4B). The time period t3 is reserved for the microprocessor 306 to wait and listen and detect to receive signals from a tag that may be within a surveillance zone of the acousto-magnetic EAS system 224 (operational act 454 in FIG. 4B). Time duration t4 is reserved for another system such as that shown on phase C to send its own pulse (operational act 458 in FIG. 4B), and t5 is the time reserved for the microprocessor 306 to wait and listen and detect the environmental noise (operational act 460 in FIG. 4B).

Figure 4E:
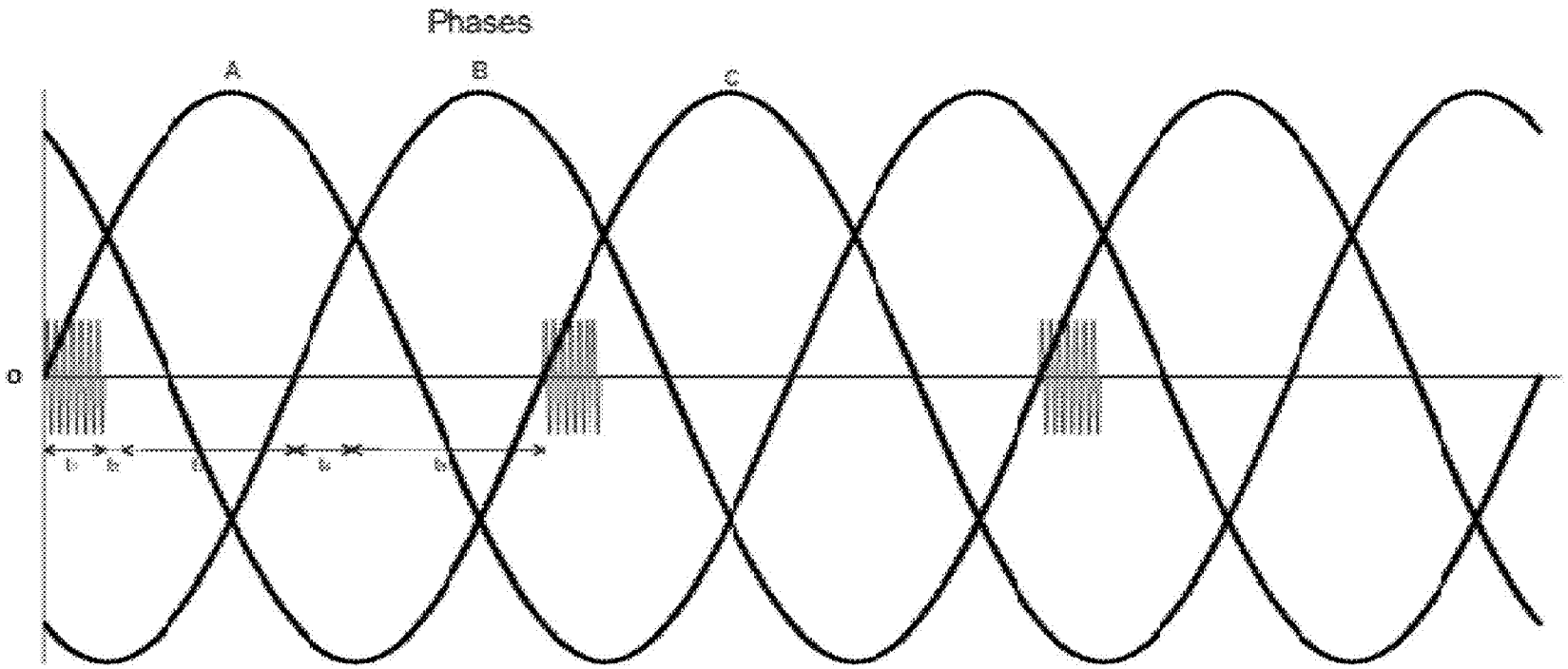
Figure 4F:
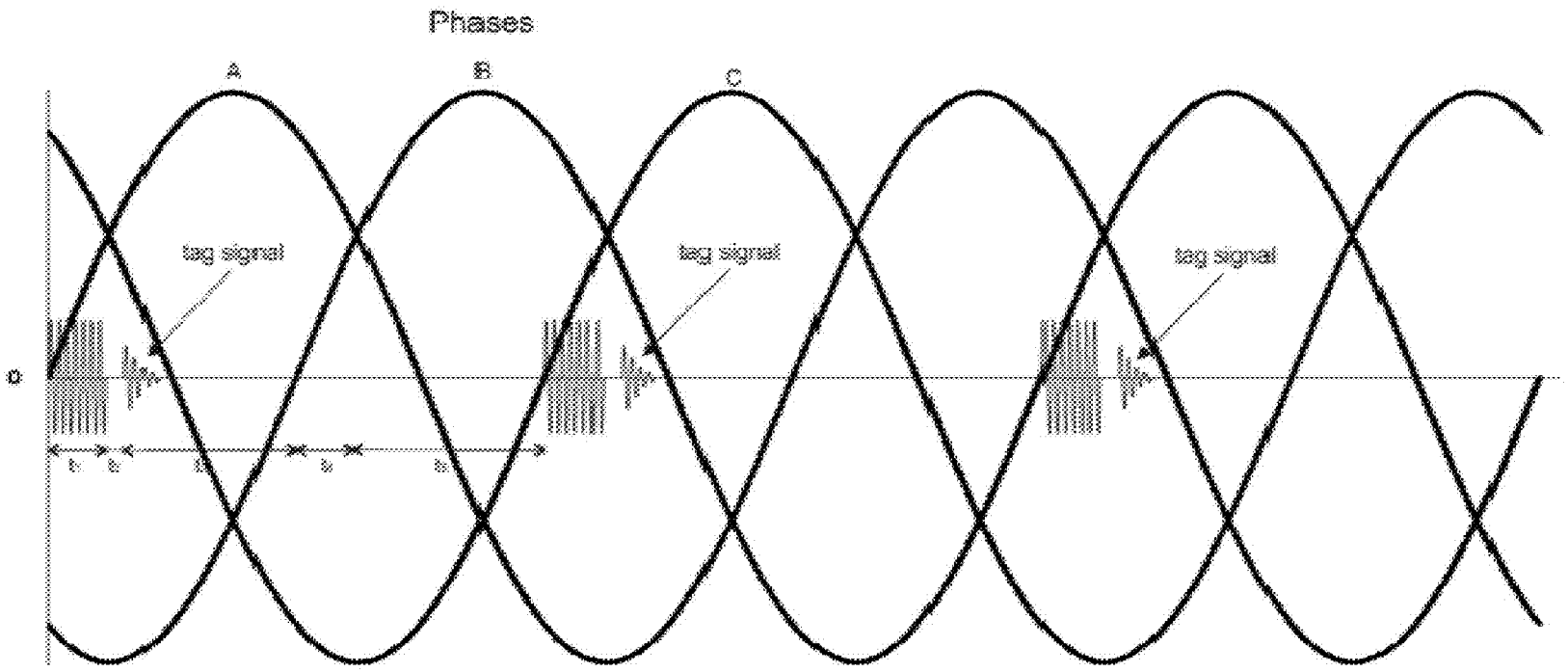
Figure 4G:
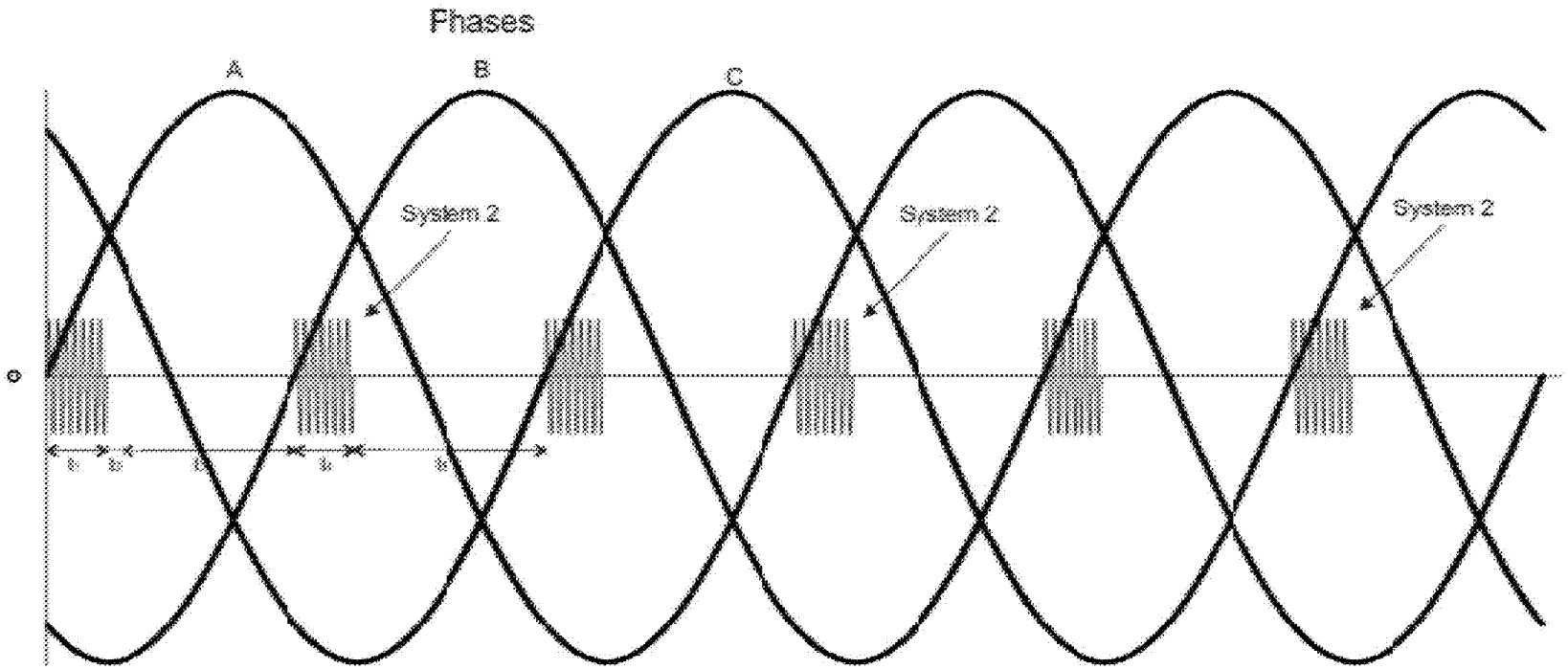
Figure 4H:
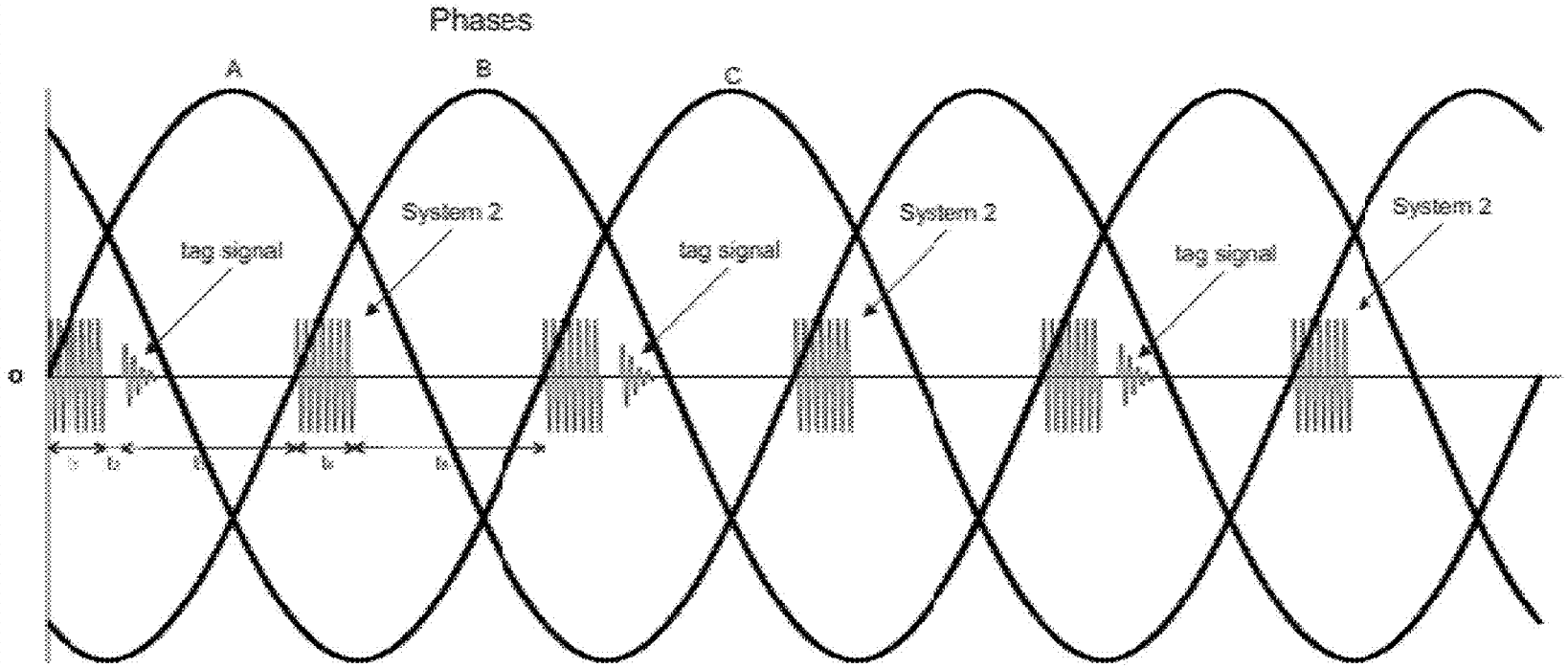
Figure 4I:
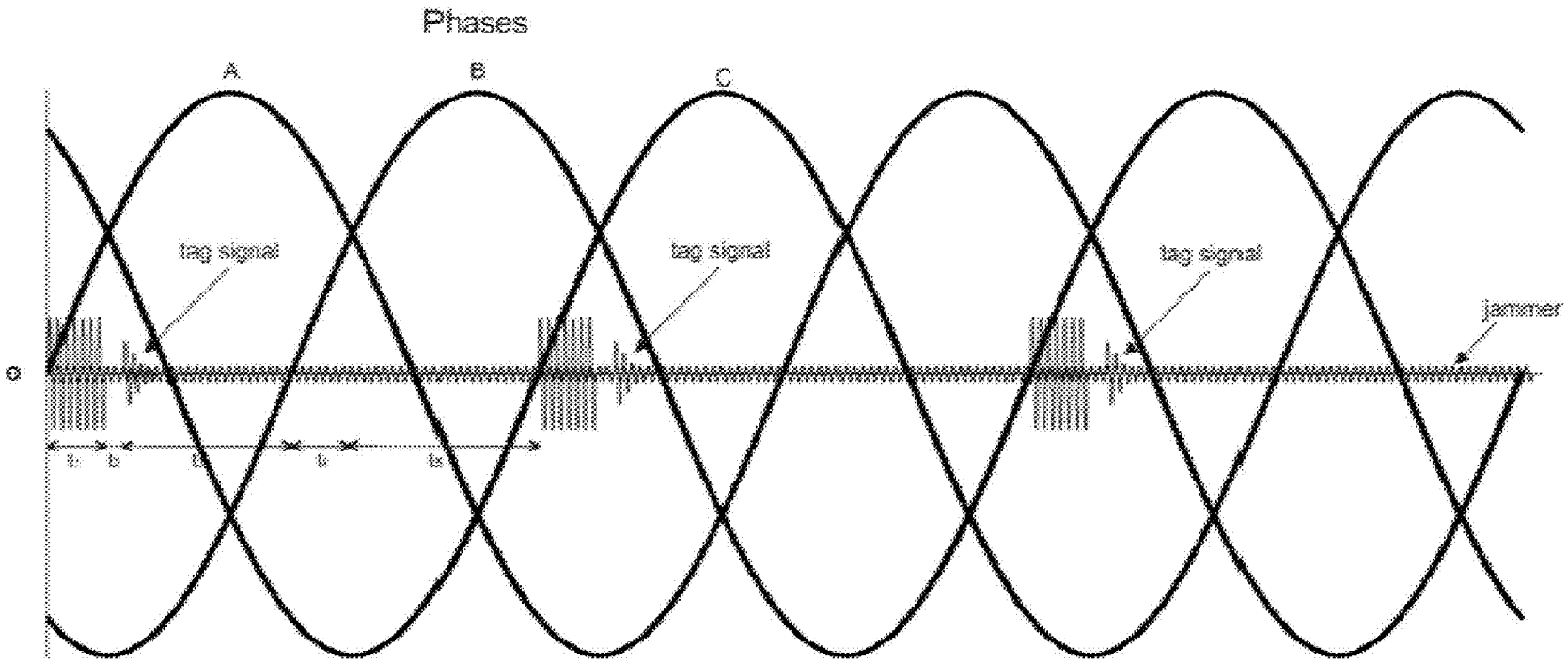

FIG. 4E illustrates the signaling for the acousto-magnetic EAS system with no tag signal transmission. As illustrated, there is no tag signal at t3. FIG. 4F illustrates the same, but includes a tag response, which is within the time period t3. FIG. 4G is an exemplary signaling illustration for two independent acousto-magnetic EAS systems 224, which due to synchronization, start sending out signals at zero-crossing and at times t1 and t4, with no tag transmission (no tag is present). FIG. 4H is an exemplary signaling illustration as shown in FIG. 4G, but includes a tag response from within system 1, at time period t3 on phase line A. Finally, FIG. 4I is an exemplary signaling illustration that shows system operating with a tag (tag output at time t3), which is also jammed by a jammer. As illustrated, the jammer signal is similar to that of a tag signal, but is continuous in time rather than in bursts. It should be noted that a jammer signal will (at the very least) be detected at time t3 (where the system is expecting a signal from the tag) and at time t5, which is reserved for detection of background or ambient signal only. Accordingly, the jammer signal is a continuous signal, is not in bursts, and is not synchronized with the timed sequence of events associated with the entire system, making it possible for its detection. It should be noted that all times t1, t2, t3, . . . to are programmable and may be changed, this also applies to all signals and signal features or characteristics (e.g., start and end of pulses, number of pluses, pulse width, pulse strength, duration, amplitude, period, frequency, phase, repetition, etc.).

Referring back to FIG. 4A (and in combination with FIGS. 4D to 4I), after the operational act 452, at the operational act 405, the microcomputer 306 waits for a duration of t2 for the pulse that commenced at t1 to have time to settle. Thereafter, at the operational act 454 the received signals are sampled (described in detail in relation to FIG. 4A). That is, this is the duration t3 where the received signal may be a signal from a tag or a jammer unit. At the operational act 456, the microcomputer 306 stores the sampled results (tag or jammer signals), and waits at operational act 458. This wait is for a duration t4, which provides sufficient time for other system to transmit their respective pulses. At operational act 460, the microcomputer samples further data, but this time for noise (or possibly jammer signal) from the receiver antenna for a duration t5, and stores the received data at the operational act 462 (described in detail in relation to FIG. 4D). The above-described processing operational functions are repeated "P" times in accordance with an exemplary counter mechanism control 463, 465, and 467.

At operational act 464, all signals stored are filtered and at operational act 466 they are analyzed. At operational act 468, it is determined if a matching alarm tag criteria is met. That is, if a possible tag signal was picked up at time duration t3 at the operational act 454. If it is determined that no tag signal was received, then it is determined at the operational act 470 if a jammer signal was received. In other words, was a jammer signal picked up at the operational act 454 (duration t3) and/or the operational act 460 (duration t5). Stated otherwise, at the operational act 470 it is determined if a match for jammer alarm criteria exist. As described above in relation to FIG. 4L, this can be the detection of continuous signal at time t3 and time t5, where the system is expecting a signal burst from the tag at time t3 and at time t5, where the system is listening for noise. Accordingly, the operational act 472 is executed where an alarm is sound and the jammer information is forwarded to a computer (if the computer has requested such information, which is determined at operational act 474.) If it is determined that a tag signal was received (at operational act 468) or a jammer signal is detected (at the operational act 470), an alarm is triggered at operational act 472, and communicated with an outside computer.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a sequence, an order, a serial, and or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A security system, comprising:

a point of sale (POS) structure; and an Electronic Article Surveillance (EAS) system that is associated with the POS structure to detect EAS tags;

the EAS system includes an EAS antenna that is inconspicuously associated with the POS structure, with the EAS antenna generating an EAS field at the POS that defines a POS EAS surveillance zone to detect the EAS tags within the POS EAS surveillance zone;

the EAS system discreetly communicates detection of the EAS tags with an indicator, which is inconspicuously associated with the POS structure;

the indicator is continuously driven and maintained in a first mode of operation as a result of existence of the EAS tags within the POS EAS surveillance zone until all the EAS tags within the POS EAS surveillance zone are neutralized at which point, the indicator is continuously driven and maintained in a second mode of operation.

2. The security system as set forth in claim 1, where:

the POS structure includes a transaction side and a transaction processing side.

3. The security system as set forth in claim 1, where:

the indicator is one of an audio indicator, a visual indicator, and an audio-visual indicator.

4. The security system as set forth in claim 3, where:

the indicator is positioned at the transaction processing side of the POS structure.

5. The security system as set forth in claim 1, where:

the EAS antenna is connected with the POS structure.

6. The security system as set forth in claim 1, where:

the EAS antenna is positioned at a transaction side of the POS structure.

7. The security system as set forth in claim 1, where:

the EAS system further includes a transceiver controller module that couples with the EAS antenna system for controlling transmission and reception of EAS signals.

8. The security system as set forth in claim 1, where:

EAS tags are neutralized using a deactivator.

9. A security system, comprising:

a point of sale (POS) structure;

a POS system associated with the POS structure;

an Electronic Article Surveillance (EAS) system that is associated with the POS structure to detect EAS tags; and an EAS tag deactivator;

the EAS system includes an EAS antenna that is inconspicuously associated with the POS structure, with the EAS antenna generating an EAS field at the POS that defines a POS EAS surveillance zone to detect the EAS tags within the POS EAS surveillance zone;

the EAS system discreetly communicates detection of the EAS tags with an indicator, which is inconspicuously associated with the POS structure;

the indicator is continuously driven and maintained in a first mode of operation as a result of existence of the EAS tags within the POS EAS surveillance zone that are not neutralized by the EAS tag deactivator;

the indicator is continuously driven and maintained in a second mode of operation when all of the detected EAS tags within the POS EAS surveillance zone are neutralized by the EAS tag deactivator.

10. The security system as set forth in claim 9, where:

the POS structure includes a transaction side and a transaction processing side.

11. The security system as set forth in claim 9, where:

the EAS antenna is positioned at a transaction side of the POS structure.

12. The security system as set forth in claim 9, where:

the indicator is positioned at a transaction processing side of the POS structure.

13. The security system as set forth in claim 9, where:

the indicator is one of an audio indicator, a visual indicator, and an audio-visual indicator.

* * * * *